US006619200B2

(12) United States Patent
Cacchi

(10) Patent No.: US 6,619,200 B2
(45) Date of Patent: Sep. 16, 2003

(54) METHOD FOR PRODUCING FLEXOGRAPHIC PRINTING SLEEVES, AND THE SLEEVE OBTAINED

(75) Inventor: Gabriella Cacchi, Avola (IT)

(73) Assignee: Cielle Imballaggi di Tommaso Loreto S.r.l., Avola (IT)

( * ) Notice: Subject to any disclaimer, the term of this patent is extended or adjusted under 35 U.S.C. 154(b) by 0 days.

(21) Appl. No.: 10/120,524

(22) Filed: Apr. 12, 2002

(65) Prior Publication Data

US 2002/0178953 A1 Dec. 5, 2002

(30) Foreign Application Priority Data

May 31, 2001 (IT) ..... MI2001A1164

(51) Int. Cl.[7] ..... B41F 5/00

(52) U.S. Cl. ..... 101/216; 101/415.1; 101/217; 101/382.1; 101/378; 492/28; 492/49; 492/52

(58) Field of Search ..... 101/216, 217, 101/375–376, 415.1, 382.1, 378; 492/22, 25, 28, 36, 49, 52

(56) References Cited

U.S. PATENT DOCUMENTS

| | | | | | |
|---|---|---|---|---|---|
| 3,128,700 | A | * | 4/1964 | Kunetka | 101/379 |
| 3,210,187 | A | * | 10/1965 | Thommes | 430/271.1 |
| 3,358,598 | A | * | 12/1967 | Middleton | 101/378 |
| 4,515,375 | A | * | 5/1985 | Bleckmann et al. | 277/316 |
| 4,828,641 | A | | 5/1989 | Werther et al. | |
| 5,715,750 | A | | 2/1998 | Goovaard | |

FOREIGN PATENT DOCUMENTS

| | | | | |
|---|---|---|---|---|
| GB | 1 261 603 | | 1/1972 | |
| JP | 04284251 | A * | 10/1992 | B41F/27/12 |
| JP | 07251978 | A * | 10/1995 | B65H/7/06 |
| JP | 09179376 | A * | 7/1997 | G03G/15/02 |
| JP | 11158455 | A * | 6/1999 | C09J/201/00 |
| WO | 99/06212 | | 2/1999 | |

* cited by examiner

*Primary Examiner*—Andrew H. Hirshfeld
*Assistant Examiner*—Andrea Hence
(74) *Attorney, Agent, or Firm*—Young & Thompson

(57) ABSTRACT

A method for producing sleeves for mounting flexographic printing plates, in which a flexible layered sleeve structure (1) is formed, selected parts (7) being removed from a first (4) of its layers, namely that which is to adhere to a printing cylinder, to leave empty regions for receiving double-sided adhesive tape for fixing the sleeve to the printing cylinder.

17 Claims, 2 Drawing Sheets

METHOD FOR PRODUCING FLEXOGRAPHIC PRINTING SLEEVES, AND THE SLEEVE OBTAINED

BACKGROUND OF THE INVENTION

The present invention relates both to a method for obtaining a sleeve for mounting flexographic printing plates, and to the sleeve itself.

Italian patent 1,293,502 describes a sleeve for mounting printing plates on flexographic printing machine cylinders. It refers to a sleeve formed from a transparent flexible polymer film or sheet substantially indeformable in its plane, such as polyester, and constituting the development of all or part of the cylinder on which the sleeve is applied by strips of adhesive tape. The patent describes the operability, use and advantages of this known sleeve.

The sleeve proposed in that patent is composed of a single material, i.e. a single layer, and presents a problem deriving from the thickness difference due to the application of the double-sided adhesive tape for fixing the sleeve to the printing cylinder. This problem is of considerable importance because it prejudices production of high quality printing work and also does not enable optimum printing of continuous work or total background work (where the edges of the photopolymer (plate) join together to obtain a continuous print over the entire cylinder surface).

Other currently available known solutions, mainly empirical, are hardly practical and are used for low profile or low quality work in that they present even more serious thickness difference problems and in particular do not enable efficient fixing to the cylinder, so totally prejudicing the entire print quality.

OBJECT OF THE INVENTION

The main object of the present invention is to improve the known sleeve by proposing both a method for producing an improved sleeve and the improved sleeve itself, by which better fixing to the printing cylinder is achieved.

Another object of the present invention is to provide a sleeve, of which that surface to be fixed to the cylinder is substantially uniform, so eliminating any printing problem while at the same time improving the print quality.

A further important object of the present invention is to provide a sleeve for all types of printing work (whether of low or very high quality) applicable to all types of commercially available printing machines, whether of central impression, stack or in-line with extruder type, using either traditional iron cylinders or rubber sleeves.

These and further objects which will be apparent from the ensuing detailed description are attained by the invention on the basis of the technical teachings expressed by the accompanying claims.

BRIEF DESCRIPTION OF THE DRAWINGS

The invention will be more apparent from the detailed description of preferred embodiments thereof given hereinafter by way of non-limiting example and illustrated in the accompanying drawings, in which.

DESCRIPTION OF PREFERRED EMBODIMENTS

Prior to its application (fixing) to the printing cylinder by wrapping it thereabout by virtue of its flexibility, the sleeve of the invention is in the form of a rectangular or square sheet, of variable size depending on the printing repeat used.

Figure 1:
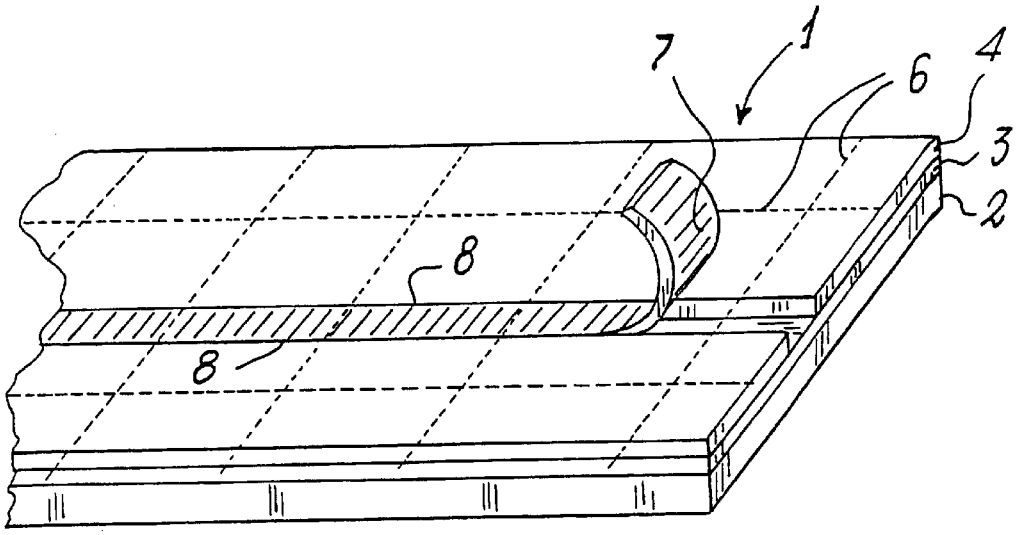
FIG. 1 is a perspective view of part of a sleeve with three flat layers.

In a first embodiment shown in FIG. 1, the sleeve 1 is formed from three flat layers, in particular from sheets of adequate thickness, respectively indicated by 2, 3 and 4. The flat layer 2, which is to adhere to the printing plate and form the outer layer of the sleeve when applied (fixed) to a printing cylinder 5 (see FIG. 2), consists of a flexible transparent polymer sheet substantially indeformable within its plane. By way of example the sheet can have a thickness between 1 micron and 1 cm and be, by way of non-limiting example, of polyester, nylon or propylene.

The also flexible intermediate layer 3, of thickness between 1 micron and 1 cm, is formed from transparent plastic material such as, by way of non-limiting example, polyethylene, polyester, nylon or propylene and, pre-printed on that face facing the outer layer 2, carries reference lines for the printing cylinder, in the form of a grid 6 (shown in FIG. 1 by dashed lines). By its adherence to the layer 2 the printing grid becomes protected and made permanently unerasable.

The again flexible and flat inner layer 4, which is to adhere to the printing cylinder, has, according to a fundamental aspect of the invention, certain of its parts selectively removable, these being in the form of spaced-apart strips with parallel edges, only one being shown in FIG. 1 in which it is indicated by hatching with the reference numeral 7. This inner layer 4 can consist of adequately flexible polymer material such as polyethylene, polyester, nylon or polypropylene and have a thickness between 1 micron and 1 cm.

The strips 7, to be removed before applying the sleeve to the printing cylinder, are defined laterally, for the purpose of their removability, by cuts 8 formed for example by a conventional cutter and possibly using a template to obtain a straight and precise parallel cut. The cuts can be made manually, automatically or electronically.

These cuts enable the material strips 7 to be removed, there then being inserted in the space left by the removed material a conventional double-sided adhesive tape (not shown) having substantially the same thickness as the material removed, the thickness of the material of the layer 4 hence being chosen on the basis of that of the double-sided adhesive tape or vice versa, and also the relative width. The purpose of the double-sided adhesive tape is to fix the sleeve to the printing cylinder. The cuts are made after the various layers have been coupled together. The sleeve is formed by coupling the various layers together using an adhesive material of characteristics suitable for maintaining its adhesiveness with time, while at the same time allowing easy removal of the material strips 7 which are to be replaced by the double-sided adhesive tape. Non-limiting examples of adhesive materials include: one- or two-component polyurethane glues without solvent, urethane and polyurethane glues with solvent, and generally those glues or adhesives used in the production of flexible laminates.

Variants to the aforedescribed detailed solution, all lying within the scope of the invention, are as follows:

- the printing grid 6 is reproduced on the inner face of the layer 2 instead of on the outer face of the intermediate layer 3;
- the intermediate layer 3 is not used, the printing grid 6 is reproduced on the inner face of the layer 2 and protected by a transparent lacquer or varnish such as a heat-resistant lacquer or varnish based on vinyl, nitrocellulose or polyurethane resins.

The sleeve of the invention ensures perfect centering of the work during the mounting process and perfect adherence of the sleeve to the printing cylinder (or rubber sleeve) during the printing process.

These results are attained precisely by the fact of the sleeve being formed of different layers, in that the intermediate layer (or in certain cases the outer layer) carries printed thereon all the print reference lines for the cylinder, and certain regions (strips) of the inner layer are removable, these regions then being replaced by double-sided adhesive tape to enable the sleeve to adhere to the cylinder; as the thickness of the removed layer is substantially equal to the thickness of the double-sided adhesive tape used for the fixing to the cylinder, a thickness uniformity is created which ensures perfect print quality and avoids all those annoying errors (printing stains, pressure impressions, etc.) due to thickness differences arising when using known products. These results are also accompanied by the following:

- a definite reduction in machine down-times for work changeover on flexographic machines; work changeover takes 3–4 minutes per colour against the 15–18 minutes of traditional systems; a substantial increase in machine productivity;
- a reduction in print errors;
- a considerable saving of double-sided adhesive tape, which is used only for initial mounting, and not for subsequent mounting or subsequent working;
- a possible reduction in capital investment on printing cylinders, sleeve systems and plate mounting equipment;
- a substantial reduction in the risk of damaging polymer plates (by tearing, breakage or deformation);
- a lower risk of accidents as a result of reduced handling of printing cylinders during work changeover.

Figure 2:
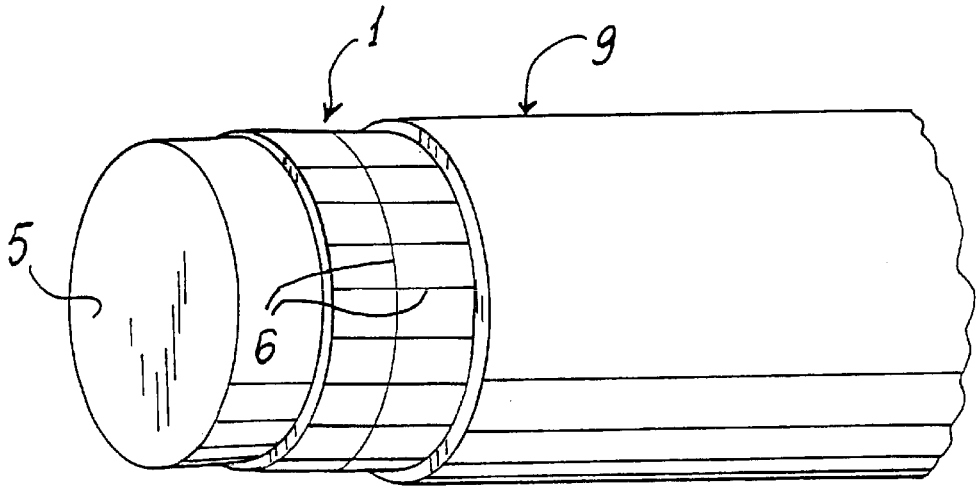
FIG. 2 is a perspective view of the sleeve in use on a printing cylinder.
Figure 3:
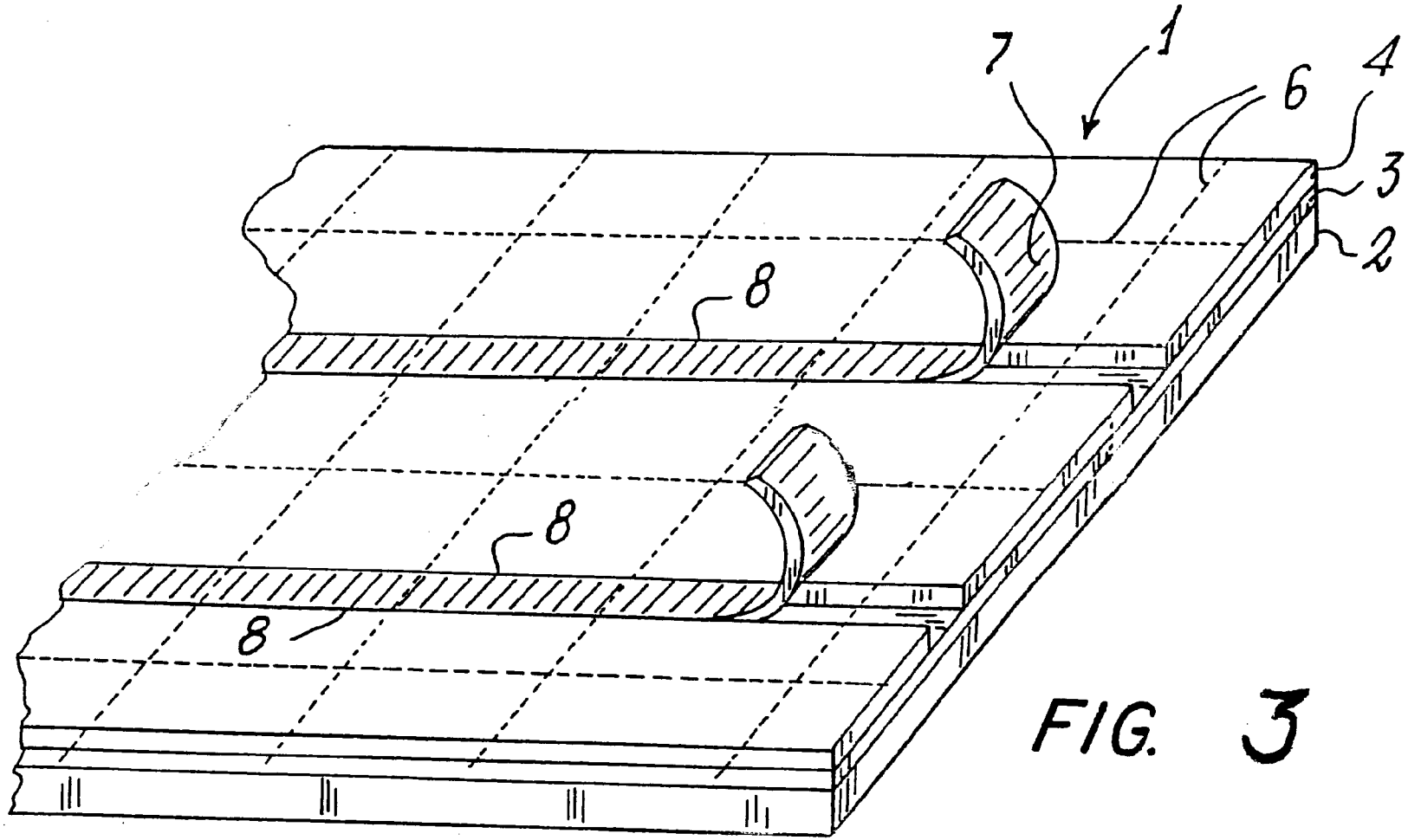
FIG. 3 is a perspective view of the sleeve with selected parts removed from the first layer to form empty regions.

FIG. 2 shows a printing cylinder 5 on which the sleeve of the invention is mounted together with the photopolymer (plate) 9. To apply the sleeve prepared as aforestated, the part containing the double-sided adhesive tape merely has to be applied to the printing cylinder 5 to obtain perfect adhesion while at the same time maintaining thickness uniformity.

On termination of printing, the multi-layer sleeve 1 (on which the photopolymer printing plates are already applied) can be easily detached from the cylinder 5 and stored, ready for subsequent working.

The invention also solves the particular problems deriving from continuous (or full background) printing, i.e. when the two end edges of the printing plate have to mate to ensure printing continuity; with the sleeve of the invention, as the double-sided adhesive tape is placed in the appropriate seats left by removing the strips 7 on the rear of the each sleeve and the sleeves thickness remains constant throughout the entire cylinder extension, this type of printing can be effected without using joints or adhesive tape applications which would prejudice the print quality.

What is claimed is:

1. A method for producing a sleeve for mounting a flexible printing plate on a printing cylinder, said sleeve comprising a flexible multi-layered structure, said method comprising the steps of removing selected parts from a first layer of said multi-layered structure to form empty regions; and fixing a double-sided adhesive tape in said empty regions, wherein said first layer is adhered to the printing cylinder by said adhesive tape and an outer surface of said sleeve is adhered to said plate.

2. A method as claimed in claim 1, wherein the selected parts (7) to be removed from said first layer (4) are parallel strips.

3. A method as claimed in claim 2, wherein the strips (7) are made separable by providing cuts (8) in said first layer (4).

4. A method as claimed in claim 2, characterized in that said first layer (4) from which the strips (7) are removed, and the double-sided adhesive tape, have substantially the same thickness.

5. A method as claimed in claim 2, wherein the width of the strips (7) removed from said first layer, and the width of the double-sided adhesive tape, are substantially equal.

6. A method as claimed in claim 3, wherein the depth of the cuts(8) substantially corresponds to the thickness of said first layer (4).

7. A method as claimed in claim 1, wherein a second layer of the layered sleeve structure (1) is formed from flexible transparent polymer material substantially indeformable within its plane, said second layer being that to which a photopolymer printing plate (9) is made to adhere.

8. A method as claimed in claim 1, wherein a third layer (3) of the layered sleeve structure (1) is formed from flexible polymer material, said layer being interposed between said first layer (4) and second layer (2).

9. A method as claimed in claim 8, wherein a printing grid (6) is printed on said third layer (3).

10. A method as claimed in claim 7, wherein a printing grid (6) is printed on said second layer (2).

11. A method as claimed in claim 7, wherein the printing grid (6) printed on said second layer (2) is protected by lacquering or varnishing.

12. A plate sleeve for flexographic printing, comprising a flexible multi-layered structure having selected parts removed from a first layer of said structure to form empty regions; and a double-sided adhesive tape in said empty regions, wherein said first layer is affixable to a printing cylinder by said tape.

13. A sleeve as claimed in claim 12, wherein in addition to said first layer (4) there are provided a second (2) and a third (3) layer, on one of which a printing grid (6) is printed.

14. A sleeve as claimed in claim 12, wherein the removable parts (7) are pre-cut parallel strips (8) in said first layer (4).

15. A sleeve as claimed in claim 14, wherein the removable strips (7) have their thickness and preferably also their width substantially equal to those of the double-sided adhesive tapes.

16. A sleeve as claimed in claim 12, comprising two layers, namely the first (4) and the second (2), a printing grid (6) printed on said second layer (2) on that side facing said first layer (3), and protection varnishing or lacquering for said printing grid (6) on said side.

17. A sleeve as claimed in claim 12, wherein the layers of the layered structure (1) are of flexible polymer material joined together by adhesive.

* * * * *